US008016978B2

(12) United States Patent
Sauter et al.

(10) Patent No.: US 8,016,978 B2
(45) Date of Patent: Sep. 13, 2011

(54) METHOD AND APPARATUS OF MANUFACTURING A HYGIENE PAPER PRODUCT

(75) Inventors: Jurgen Sauter, Mannheim (DE); Wolfram Schinkoreit, Unterabtsteinach (DE); Dirk Mauler, Ilvesheim (DE)

(73) Assignee: SCA Hygiene Products GmbH, Mannheim (DE)

( * ) Notice: Subject to any disclaimer, the term of this patent is extended or adjusted under 35 U.S.C. 154(b) by 981 days.

(21) Appl. No.: 11/909,529

(22) PCT Filed: Mar. 22, 2005

(86) PCT No.: PCT/EP2005/003056

§ 371 (c)(1), (2), (4) Date: Nov. 5, 2007

(87) PCT Pub. No.: WO2006/099881

PCT Pub. Date: Sep. 28, 2006

(65) Prior Publication Data

US 2010/0163194 A1 Jul. 1, 2010

(51) Int. Cl.

| | |
|---|---|
| ***D21H 27/02*** | (2006.01) |
| ***D21H 27/30*** | (2006.01) |
| ***B31F 1/07*** | (2006.01) |

(52) U.S. Cl. ..... 162/114; 162/117; 162/260; 162/253; 162/118; 162/120; 101/32; 101/484

(58) Field of Classification Search ..... 162/109–117, 162/134–136, 362, 204, 265, 253, 260, 118, 162/120, 194; 428/152–154, 211.1; 101/32, 101/484–486, DIG. 46

See application file for complete search history.

(56) References Cited

U.S. PATENT DOCUMENTS

| | | | | |
|---|---|---|---|---|
| 1,967,726 | A | 7/1934 | Sherman | |
| 4,545,780 | A | 10/1985 | Martin | |
| 5,802,974 | A * | 9/1998 | McNeil | 101/226 |
| 2004/0261639 | A1 * | 12/2004 | Vaughn et al. | 101/248 |
| 2005/0153100 | A1 * | 7/2005 | Zoller et al. | 428/131 |

FOREIGN PATENT DOCUMENTS

| | | |
|---|---|---|
| DE | 19959832 | 7/2001 |
| EP | 0922422 | 6/1999 |
| WO | 9609162 | 3/1996 |

* cited by examiner

*Primary Examiner* — Eric Hug
(74) *Attorney, Agent, or Firm* — Young & Thompson

(57) ABSTRACT

Method of manufacturing a hygiene paper product in form of a continuous paper web (W) of sheets partly separated by perforation lines (9) and wound to a log of predetermined longitudinal length, providing a continuous paper web (W), moving the continuous paper web in a direction of its longitudinal extension, providing at least one embossed pattern on the continuous paper web, providing in the area of an embossing station at least one mark (6, 7) onto the continuous paper web, which mark (6, 7) is in register to the embossed pattern, sensing the mark and controlling perforating means for registering the perforation lines (9) with the embossed pattern thereby imparting perforation lines to the continuous paper web in predetermined longitudinal distances, winding up the resulting web to logs, and cutting the log into rolls.

24 Claims, 6 Drawing Sheets

METHOD AND APPARATUS OF MANUFACTURING A HYGIENE PAPER PRODUCT

TECHNICAL FIELD OF THE INVENTION

The present invention relates to a method of manufacture of hygiene paper products having at least a repeating embossing structure, as well as an apparatus for such manufacture and the respective hygiene paper products.

By embossing a pattern can by applied to a paper fulfilling a decorative and/or functional structure. A decorative structure is applied to the hygiene product for design purposes. A functional structure serves to improve the properties of the hygiene paper product, that is the functional structure may improve the product thickness, absorbency, bulk, softness, etc.

The hygiene paper product may be made of single or multi-ply tissue paper or non-woven or a combination of tissue paper and non-woven.

A tissue paper is defined as a soft absorbent paper having a low basis weight. One generally selects a basis weight of 8 to 40 g/m2, especially 10 to 25 g/m2 per ply. The total basis weight of multiple-ply tissue products is preferably up to a maximum of 80 g/m2, more preferably to a maximum of 50 g/m2. Its density is typically below 0.6 g/cm3, preferably below 0.30 g/cm3 and more preferably between 0.08 and 0.20 g/cm3. The production of tissue is distinguished from paper production by its extremely low basis weight and its much higher tensile energy absorption index (see DIN EN 12625-4 and DIN EN 12625-5). Paper and tissue paper also differ in general with regard to the modulus of elasticity that characterizes the stress-strain properties of these planar products as a material parameter.

A tissue's high tensile energy absorption index results from a creping process. Creping can be produced by pressing the paper web against a dry cylinder and as a result of the action of a crepe doctor or as a result of a difference in speed between two wires ("fabrics"). This causes the wet, plastically deformable paper web to be internally broken up by compression and shearing, thereby rendering it more stretchable under load than an uncreped paper.

Wet pressed paper webs are usually dried by the so-called Yankee drying, the through air drying (TAD) or the impulse drying method.

The fibers contained in the tissue paper are mainly cellulosic fibers, such as pulp fibers from chemical pulp (e.g. Kraft sulphite and sulphate pulps), mechanical pulp (e.g. ground wood), thermo mechanical pulp, chemo-mechanical pulp and/or chemo-thermo mechanical pulp (CTMP). Pulps derived from both deciduous (hardwood) and coniferous (softwood) can be used. The fibers may also be or include recycled fibers, which may contain any or all of the above categories. The fibers can be treated with additives—such as fillers, softeners, such as quaternary ammonium compounds and binders, such as conventional dry-strength agents or wet-strength agents used to facilitate the original paper making or to adjust the properties thereof. The tissue paper may also contain other types of fibers, e.g. regenerated cellulosic fibres or synthetic fibers enhancing, for instance, strength, absorption, smoothness or softness of the paper.

Tissue paper may be converted to the final tissue product in many ways, for example, by embossing or laminating it into a multi-ply product, rolled or folded.

The term non-woven (ISO 9092, DIN EN 29092) is applied to a wide range of products which, in terms of their properties, are located between those of paper (cf. DIN 6730, May 1996) and cardboard (DIN 6730) on the one hand, and textiles on the other hand. As regards non-woven a large number of extremely varied production processes are used, such as the air-laid and spun-laced techniques as well as wet-laid techniques. The non-woven includes mats, non-woven fabrics and finished products made thereof. Non-wovens may also be called textile-like composite materials, which represent flexible porous fabrics that are not produced by the classic methods of weaving warp and weft or by looping. In fact, non-wovens are produced by intertwining, cohesive or adhesive bonding of fibres, or a combination thereof. The non-woven material can be formed of natural fibres, such as cellulose or cotton fibres, but can also consist of synthetic fibres, such as Polyethylene (PE), polypropylene (PP), polyurethane (PU), polyester, nylon or regenerated cellulose, or a mix of different fibres. The fibres may, for example, be present in the form of endless fibres of pre-fabricated fibres of a finite length, as synthetic fibres produced in situ, or in the form of staple fibres. The nonwovens according to the invention may thus consist of mixtures of synthetic and cellulose fibrous material, e.g. natural vegetable fibres (see ISO 9092, DIN EN 29092).

Hygiene or wiping products primarily include all kind of dry-creped tissue paper, wet-creped paper and cellulose or pulp wadding or all kinds of nonwovens, or combinations, laminates or mixtures thereof. Typical properties of these hygiene and wiping products include the ready ability to absorb tensile stress energy, their drapability, good textile-like flexibility, properties which are frequently referred to as bulk softness, a high surface softness, and a high specific volume with a perceptible thickness. As high a liquid absorbency as possible and, depending on the application, a suitable wet and dry strength as well as an appealable visual appearance of the outer product surface is desired. These properties, among others, allow these hygiene and wiping products to be used, for example, as cleaning wipes such as paper or non-woven wipes, windscreen cleaning wipes, industrial wipes, kitchen paper, or the like; as sanitary products such as for example toilet paper, paper or non-woven handkerchiefs, household towels, towels, and the like; as cosmetic wipes such as for example facials and as serviettes or napkins, just to mention some of the products that can be used. Furthermore, the hygiene and wiping products can be dry, moist, wet or pre-treated in any manner. In addition, the hygiene and wiping products may be folded, interleaved or individually placed, stacked or rolled, connected or not, in any suitable manner.

Due to the above description, the products can be used for personal and household use as well as commercial and industrial use. They are adapted to absorb fluids, for decorative purposes, for packaging or even just as supporting material, as is common for example in medical practices or in hospitals. In terms of their wide variety, hygiene and wiping products are now considered to be everyday products.

Especially for the present invention toilet paper or kitchen towels or wipes are concerned, which are wound to rolls by a continuous paper web, wherein sheets are partly separated by perforation lines.

PRIOR ART

In general, hygiene paper products are known comprising a functional as well as a decorative structure. In particular, these hygiene paper products are printed and embossed. In an additional step, the hygiene paper product, which is typically made in a continuous form, is cut to discrete lengths as desired so as to form a single sheet or perforations are provided to constitute a line of weakness that enables the consumer to separate a single sheet from a plurality of sheets which may be present in the form of a roll, e.g. a toilet roll or a kitchen roll. Between the treatments, namely printing, embossing and cutting/perforating there is generally no synchronization.

In order to improve the optical appearance of the product, EP-A-0958112 discloses to synchronize or register one of the functional structures or the decorative structure with cutting or perforating. In this context, the spatial relationship between one pattern and the lines of termination (i.e. the line that separates one sheet from another either by means of a perforation or line of weakness or cutting) are set by adjusting either the rate of applying the pattern or the rate of applying the perforation or cutting, wherein the sheet is transported at a constant velocity.

U.S. Pat. No. 3,594,552 discloses a system and method for synchronizing single printing modules with each other. All used printing cylinders are rotated in unison at the same peripheral speed and the repeat rates of each printing cylinder are the same. Any failure in the synchronization is detected by a scanner detecting a reference mark on the web to be printed and, additionally, by a rotary, digital encoder. If an error is detected, it is corrected by means of a compensating device.

An apparatus for registering printed patterns with perforation lines in a continuous paper web is known from EP 0 958 112.

SUMMARY OF THE INVENTION

In view of the above, it is the technical problem of the present invention to provide a method for manufacturing a hygiene paper product, which is improved in it's optical appearance by simple mode and features, as well as to provide an apparatus for such manufacture.

The technical problem is solved by the subject matter defined in the independent claims. Further embodiments may taken from the dependent claims.

According to the present invention, the method of manufacturing a hygiene paper product in form of a continuous web of sheets partly separated by perforation lines and wound to a log of pre-determined longitudinal lengths comprises the steps of providing a continuous paper web, moving the continuous paper web in a direction of its longitudinal extension, providing at least one embossed pattern onto the continuous paper web, providing in the area of an embossing station at least one mark onto the continuous paper web, which is in register to the embossed pattern and sensing the mark and controlling perforating means for registering the perforation lines with the embossed pattern, thereby imparting perforation lines to the continuous paper web in predetermined longitudinal distances, winding up the resulting web to logs and finally cutting the logs into rolls.

It is also possible to use the already mentioned marks for registering the saw cuts in correlation to the embossing pattern.

How to realize generally sensor controlled registration and cutting can be taken from U.S. Pat. No. 3,594,552.

In this wording the word "log" defines a paper roll being not yet cut into width-units for the final product.

Separation of the last sheet of one log and the first sheet of the following log can be carried out by a standard process like breaking the perforation lines between these two sheets.

According to the method of the invention providing of at least one mark is accomplished in the area of an embossing station. It is possible to apply the mark by printing, embossing, gluing, punching or by any other method, which results in a detectable mark. The mark can also be a hole.

Especially, the mark is embossed onto the continuous paper web and a colour, especially coloured glue for ply-bonding is applied to the embossed mark. Colouring the embossed mark, especially by strong colour leads to effective sensing by (a) photodiode(s).

It is also possible to provide the mark as a printed colour-mark using for instance an ink-jet printer, a gravure printer or any other printer. Then it is possible to provide the mark in a simple manner on any side of the paper plies.

Possibly the mark is a dot-mark or MD-line-mark for cutting control or a dot-mark or CD-line-mark for register-control of perforation. In this connection MD means machine direction and CD cross machine direction.

The mark can be applied to a cookie- or trim-area of the log. This area is each the end area of the log, which is cut away and wasted. Therewith the mark is not visible on the final paper product. For instance, two different marks are applied to one and the same cookie-area at least one end of the log. It is, however, also possible to apply one of the two different marks to one cookie-area of the log and the other mark to the other cookie-area of the log. If projections are present on the embossing roll for embossing the mark to the continuous paper web vibrations can occur when revolving the embossing roll. These vibrations can be reduced or avoided by additional projections on the roll. Especially a single embossing projection for a mark can be compensated by a circumferential projection line being used itself for a mark controlling the cutting operation.

Nevertheless, it is also possible to apply one of the two different marks to one cookie-area of the log and the other mark to the other cookie-area of the log. It is also possible that any embossing design element of the embossing pattern or product design can be used as a mark. In these cases the mark or the design element which is used as a mark is usually located between the cookie areas which means it is part of the final product.

Alternatively, the at least one mark may be applied to the back side of the continuous paper web being opposite to the embossing side or the front side of the continuous paper web being the embossing side. The first alternative is preferred because it is easier to position the printing means for printing colour or coloured glue onto the embossed marks.

Preferably the mark is sensed on the front side of the continuous paper web. Since the tissue paper normally is the coloured mark on the backside shines through the paper so that sensing on the front side is possible in an easy manner when, for example, a photodiode is used as sensor.

Furthermore, the problem is solved by an apparatus for manufacturing a hygiene paper product, comprising means for feeding a continuous paper web, means for moving the continuous paper web in a direction along its longitudinal extension, at least one embossing station including at least one applicator- or printing means for applying at least one mark to the continuous paper web, at least one sensing means for sensing the at least one mark, perforating means for imparting perforation lines preferably perpendicularly to the moving direction of the continuous paper web, sensor influenced control means for controlling the registration of embossing pattern with perforations and winding means. The apparatus comprises cutting means for cutting the log into a plurality of rolls. Optionally the apparatus comprises additional sensor means for detecting the mark(s), and additional sensor influenced control means for controlling the registration of embossing pattern the cutting operation of the log.

The mark can be applied to the paper web by using embossing techniques by applying a detectable substance or by combining such embossing and application methods. Suitable substances may be for instance dyes, pigments, inks, coloured adhesives, magnetic or fluorescent substances. For detecting the mark(s) different kinds of sensors can be used, for example optical sensors (photo diodes), or magnetic sensors (DE-A 195 06 774), array sensors or cameras including electronical analysis. Light with different kinds of wavelengths can be used (for example infrared, ultraviolet or visible light). The detection can be made in transmission or reflection mode.

Preferably, a mark-projection is provided on the surface of an embossing roll. The embossing station preferably includes an applicator- or printing means for application of coloured glue onto the embossing projections for ply-bonding and for application of coloured glue onto the at least one embossed mark projection. In this way by a single operation embossing, ply-bonding and providing a mark for registration or cutting control can be provided in a simple manner.

If, for instance, the embossing station includes an applicator- or printing means for application of non-coloured (transparent), white or pale coloured adhesives, for example glue onto the embossing projections for ply-bonding at least one separate applicator- or printing means is provided for application of coloured adhesive or ink, for example, onto the embossed at least one mark projection. With such (a) mark(s) registration of perforation and embossing as well as cutting control is possible in a simple manner although transparent, white, or pale coloured adhesives are used for ply-bonding. All this may be achieved with means within the area of the station where embossing and ply-bonding is provided.

Preferably the applicator- or printing means for the marks are provided radially outside of the embossing roll and there at least at one end region thereof.

The embossed pattern should be located at the same position of the sheet after one revolution of the embossing roll.

Controlling systems useful for carrying out the process according to the invention are disclosed in U.S. Pat. No. 3,594,552 and in U.S. Pat. No. 5,292,299. The technical solution described above is suitable to control the correlation of perforation and the embossing in MD.

A further idea is to control the cut of the log saw. The position of the cut can be brought in register with the embossing. That means that an embossing design element can be placed at a defined position of the sheet in CD. According to the present invention it is possible to bring embossing also in register with the cut.

The invention also comprises that perforation in register to embossing and cutting in correlation to embossing can be combined. This can be achieved by using marking technology for registered perforation as well as for registered cutting.

Finally, the problem is solved by a hygiene paper product having the form of a continuous paper web wound to a roll comprising sheets partly separated by perforation lines perpendicularly to the longitudinal extension of the continuous paper web being provided with at least one embossed pattern being repeatedly located in registered correlation to the perforation lines and optionally to the longitudinal side edges. The embossed pattern can be positioned at any predetermined location of such sheets in a repeated manner according to the revolution of the embossing roll(s).

BRIEF DESCRIPTION OF DRAWINGS

FIG. 2*a* to FIG. 6*a* shows a diagrammatic view of a converting machine for different operation modes.

FIG. 2*b* to FIG. 6*b* shows different embodiments of embossing station according to FIG. 2*a* to FIG. 6*a*.

FIG. 2*a* and FIG. 2*b* shows converting machines according to the state of the art whereas FIGS. 3*a* and 3*b*, FIGS. 4*a* and 4*b*, FIGS. 5*a* and 5*b* and FIGS. 6*a* and 6*b* shows converting machines according to the invention.

EMBODIMENTS OF THE INVENTION

Figure 1:
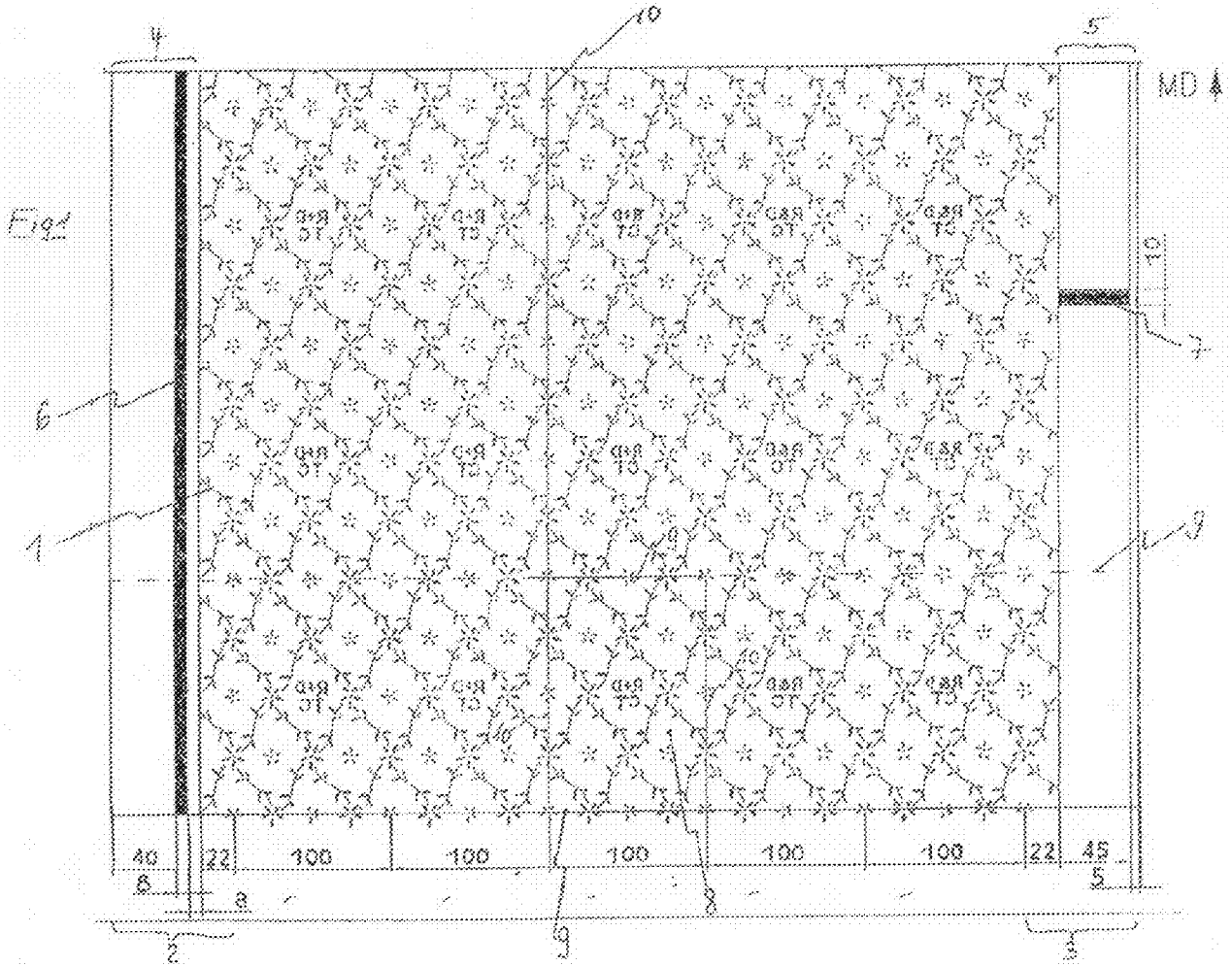
FIG. 1 shows a part of a developed circumferential surface of an embossing roll.

In FIG. 1 an embossing roll surface is illustrated. By embossing projections a pattern 1 is provided, which is in compliance with a corresponding embossed pattern on the log being the uncut roll after rewinding at the end of a converting machine. "MD" and the arrow indicate the machine direction.

Reference numbers 2 and 3 indicates for the converted product a so-called cookie-area or trim-area which is not used for the final product. Reference numbers 4 and 5 indicates within these areas having no projections for the pattern and such is free for a circumferential line projection 6 on the left side in FIG. 1 and transverse line projection 7 on the right side in FIG. 1. These embossing projections 6 and 7 are designed for providing marks onto the continuous paper web in the corresponding cookie-area. Both embossing projections may be provided at the same end of the embossing roll.

By the mark according to the embossing projection 7 is used for registration control in MD. Normally, the continuous paper web is provided with perforation lines partly separating in a row single paper sheets which are in compliance with the square angled area 8 in FIG. 1 in which the lines 9 correspond with the perforation lines of the paper product and the lines 10 with the cutting lines. By registration control in detecting the mark according to the embossing projection 7, it is ensured that the same pattern unit is located centrally in MD within the perforation lines 9, for instance wherein the letters within the pattern are in the middle in between the perforation lines 9.

The line projection 6 provides an embossed and preferably coloured mark on the continuous paper web for controlling the cut of the log into single paper rolls for the final product. The embossed mark 6 has a fixed relationship to the embossed pattern and, therewith, sensing the mark 6 in the area of the log saw the position of the first cut is made in registration with the embossed pattern and the following saw cuts are made in fixed sequences according to the width of the final-product-rolls.

Both techniques together "perforation control" and "cutting control" ensure that the same embossing pattern unit, for instance the letters are located in the centre of the sheets 8.

FIG. 2*a* to FIG. 6*a* show a converting machine including a printing station 11, an embossing station 12, a perforation station 13 and a rewinding station 14. Furthermore, however not shown, there is an additional apparatus for cutting the log after rewinding into roll-width-units for the final product.

Figure 2A:
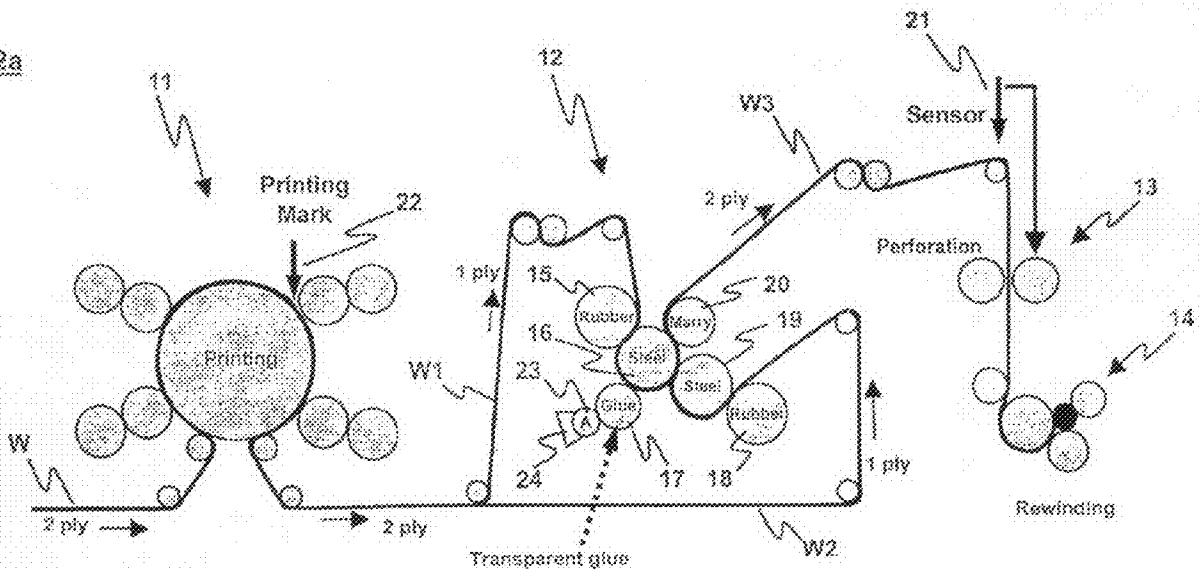

In FIG. 2*a* a 2-ply continuous paper web W is running first to the printing station. Downstream the printing station the two-plies are separated into two 1-ply continuous paper webs W1 and W2. The continuous paper web W1 is feed to the embossing station 12 where it runs into the nip between a rubber roll 15 and a steel-embossing roll 16. In this nip the continuous paper web W1 is provided with an embossment and downstream this rotation via a glue applicator device 17 glue is applied to the embossed projections of the continuous paper web W1. The other continuous paper web W2 runs into another nip between rubber roll 18 and another steel-embossing roll 19 where a pattern is embossed onto the continuous paper web W2. Thereafter the two webs are combined between the steel-embossing rolls 16 and 19 and a marry-roll 20. The 2-ply continuous paper web W3 is passing a sensor 21 detecting a mark, which is applied by a printing means 22 within the printing station 11 onto the continuous paper web W as indicated in FIG. 2*a*. By this detection in a corresponding, known system perforating in the perforation station 13 is made for registering.

Figure 2B:
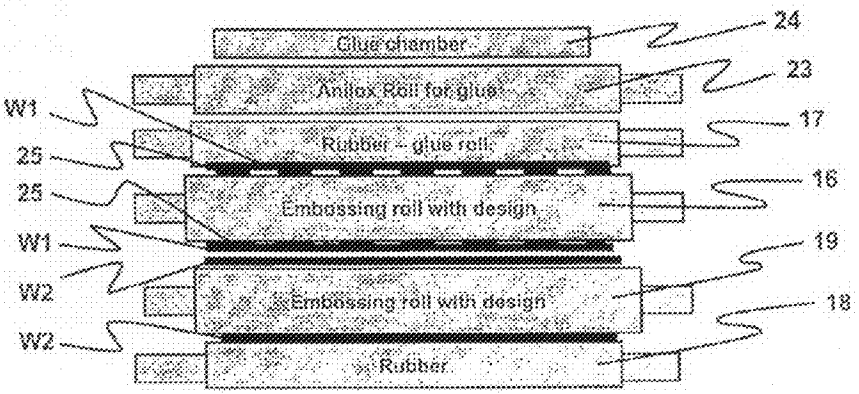

FIG. 2*b* shows schematically a view through the rubber roll 18, the steel-embossing roll 19, the steel-embossing roll 16, the rubber-glue applicator roll 17, an anilox roll 23 for metering and transferring the glue from a glue chamber 24. Here the glue is transparent glue. The print design on the web W1 including the printed mark(s) which are applied in station 11 is shown in FIG. 2*b* with the reference number 25.

In the converting machine according to FIG. 2, which represents the prior art, marking is carried out within the printing station 11, whereas according to the converting machines of this invention (FIGS. 3*a*, 4*a*, 5*a* and 6*a*) marking is carried out in the area of the embossing station.

Figure 3A:
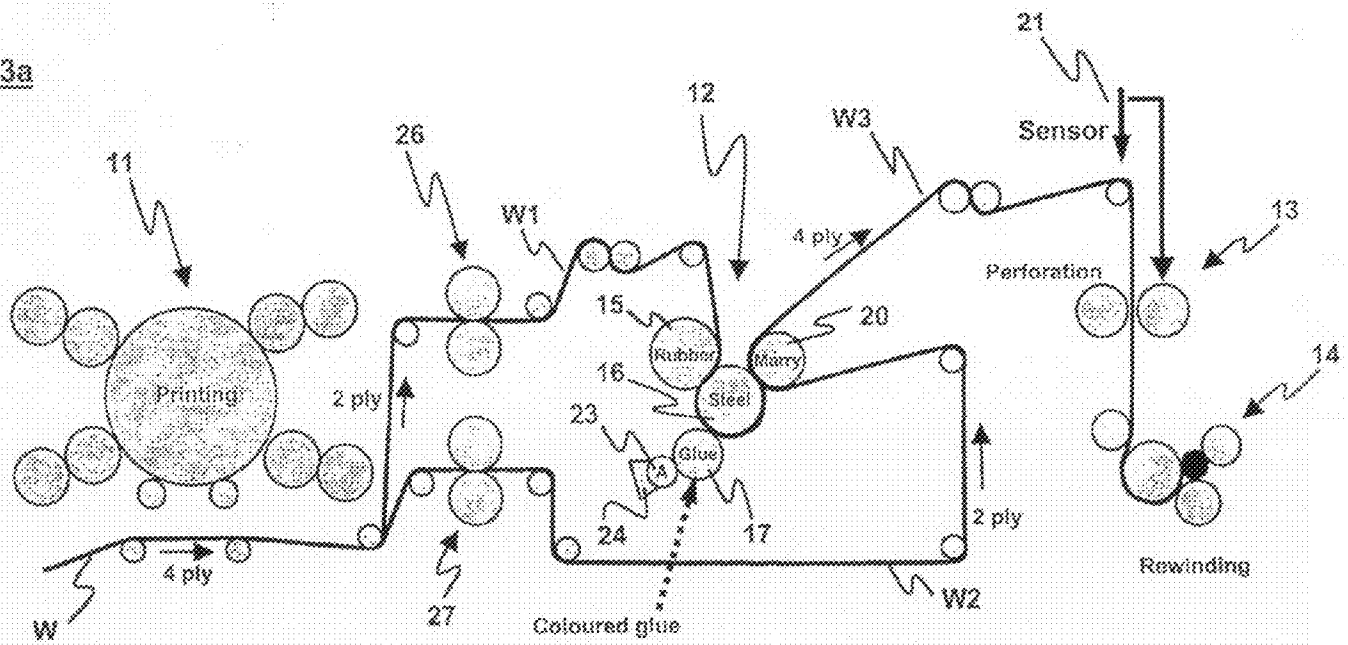

FIG. 3*a* shows a similar converting machine as illustrated in FIG. 2*a*, however, in which the printing station 11 is not in use. Here a 4-ply continuous paper web W is used as an example, which is split into two ply continuous paper webs W1 and W2. Each web W1 and W2 in this embodiment are embossed with a pre-embossing pattern. By this embossing the web W1 runs through a pair of embossing rollers 26 and the web W2 through a pair of embossing rollers 27. The continuous steel paper web W1 runs than into the nip of a rubber roll 15 and an embossing roll 16 where a pattern including marks is embossed as being visible from FIG. 1 as an example. By the glue application means 17, 23, 24 coloured glue is applied to the embossed pattern including the embossed marks achieved by the projection 6 and 7. Then the continuous paper webs W1 and W2 are combined in the nip between the steel embossing roll 16 and the marry-roll 20. The mark 7 is detected by the sensor 21 and perforation in the perforation station 13 is achieved in the intended matter by sensor control in order to make a registration of the pattern as explained in connection with FIG. 1. In this embodiment a coloured glue is used for ply-bonding and for the mark(s).

Figure 3B:
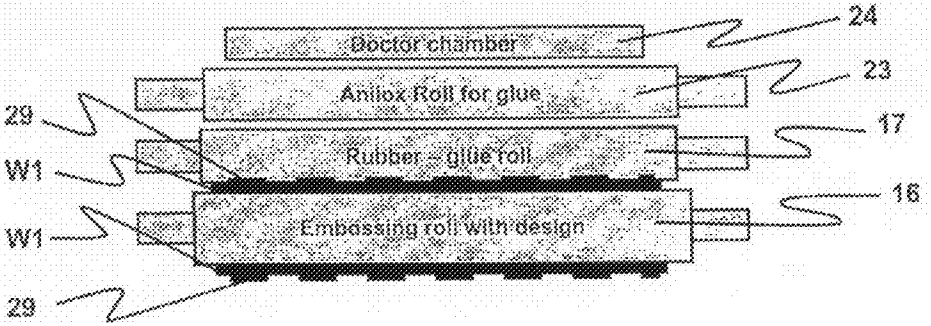

FIG. 3*b* shows schematically a view through the steel embossing roller 16, the rubber roller 17, the anilox roll 23 and the doctor chamber 24 for application of coloured glue. The number 29 refers to coloured glue on the web W1 including coloured glue mark(s).

Figure 4A:
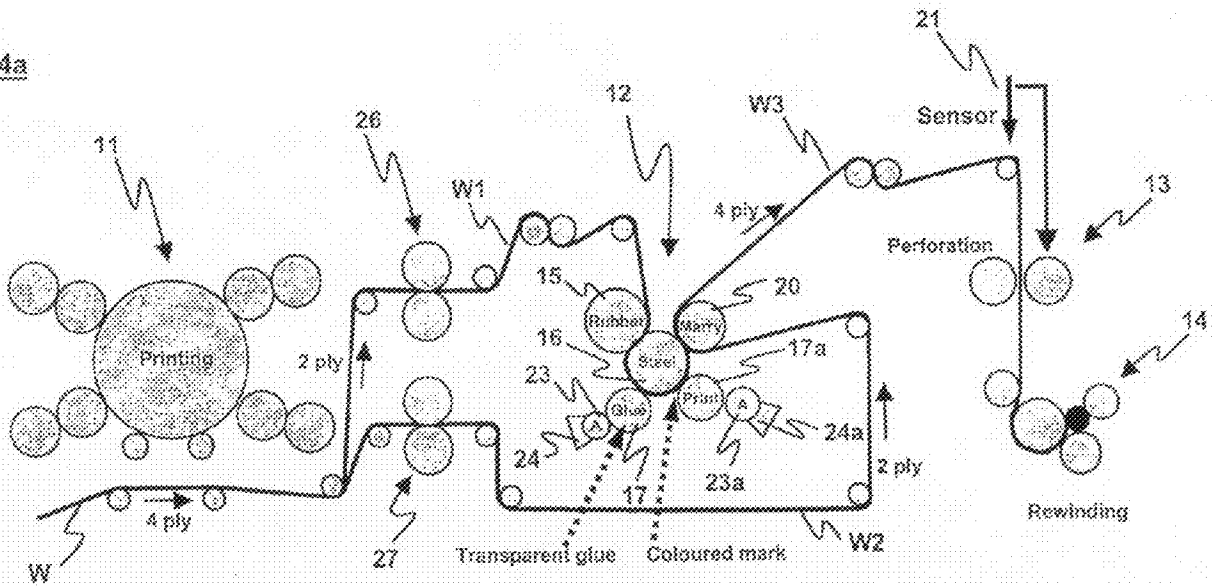
Figure 4B:
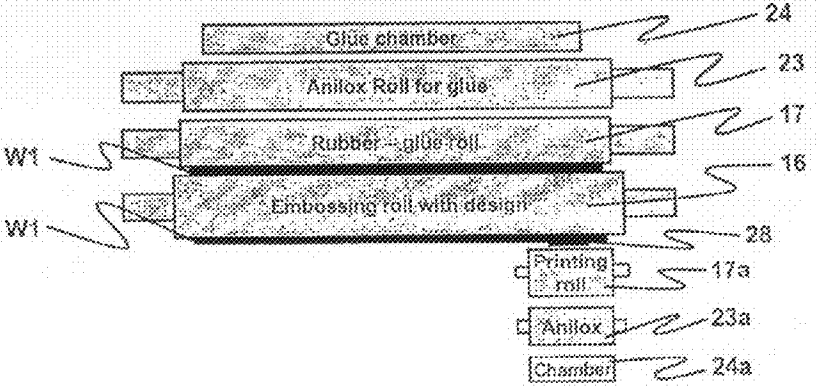

The converting machine according to FIG. 4*a* differs from the converting machine illustrated in FIG. 3*a* in that a transparent or light coloured glue is used for ply-bonding, which is not or difficult to detect by the sensor 21, especially when photodiodes are used for detecting the mark. For printing a colour to the embossed mark according to the embossing projection 7 is applied by a printing roller 17*a* working together with the anilox roller 23*a* and the chamber 24*a*. In FIG. 4*b* the printing colour has the reference number 28. The printing means 17*a*, 23*a*, 24*a* are provided at one end of the embossing roller and the converting machine.

Figure 5A:
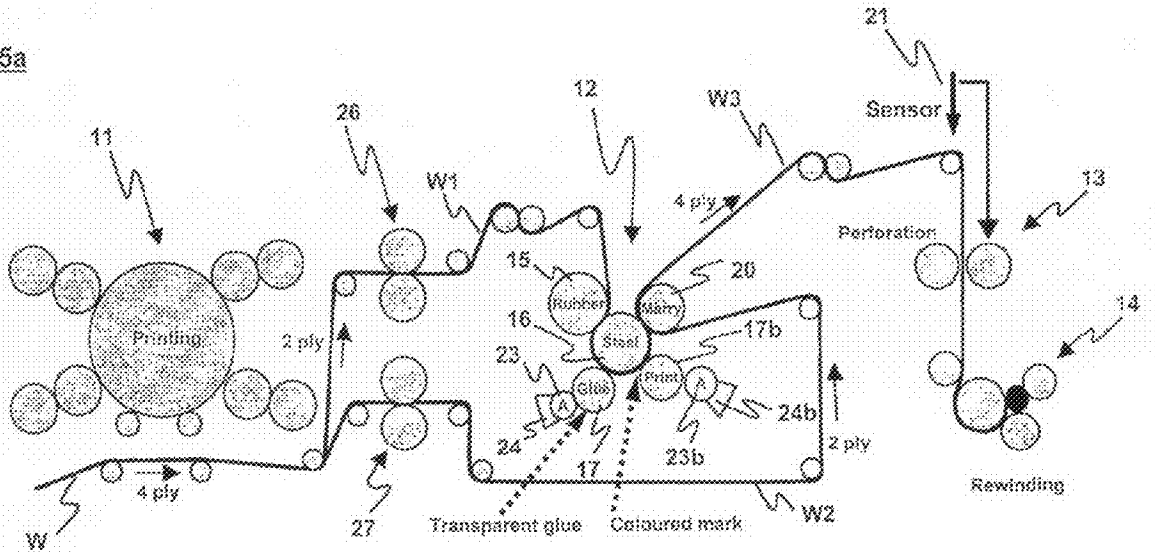
Figure 5B:
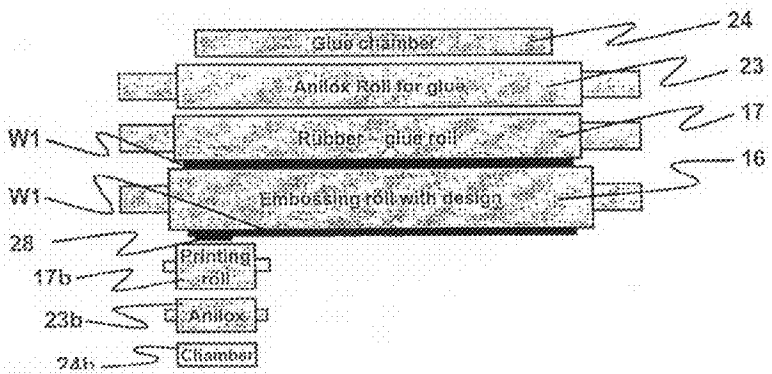

The converting machine according to FIG. 5*a* differs from the one illustrated in FIG. 4*a* in that a corresponding printing means 17*b*, 23*b*, 24*b* is provided for colouring an embossed mark achieved with the embossing projection 6 of the embossing roller and the converting machine, which is illustrated especially in FIG. 5*b*. In this embodiment cutting of the log by a logsaw (not shown here) is controlled via the mark. A sensor is mounted on the log saw and detects the mark for controlling the registered cutting of the log.

Figure 6A:
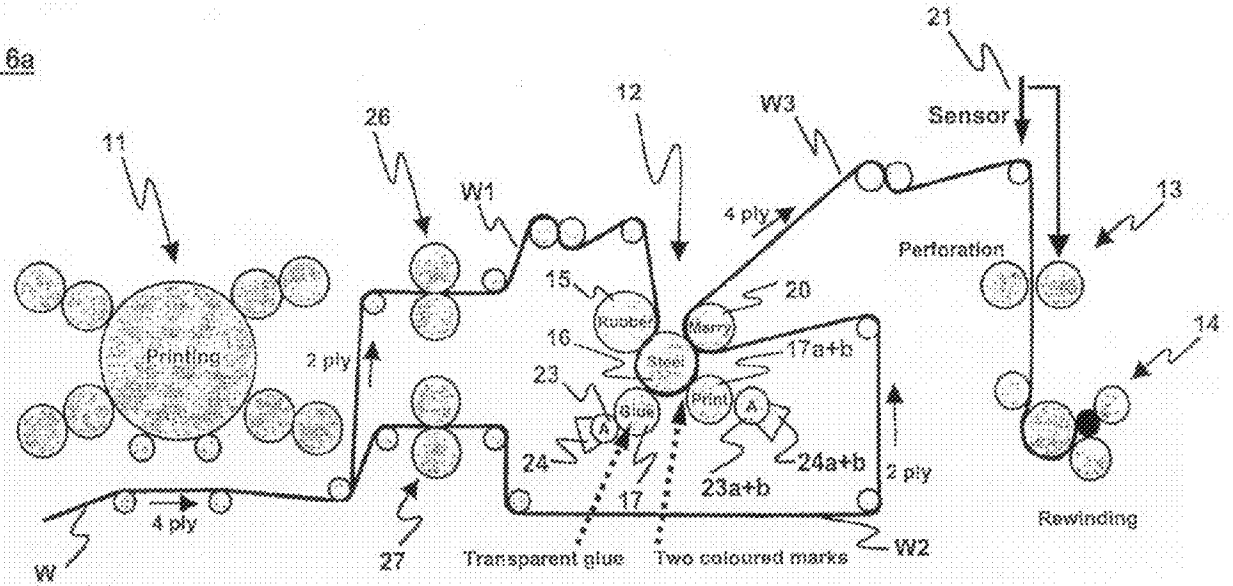
Figure 6B:
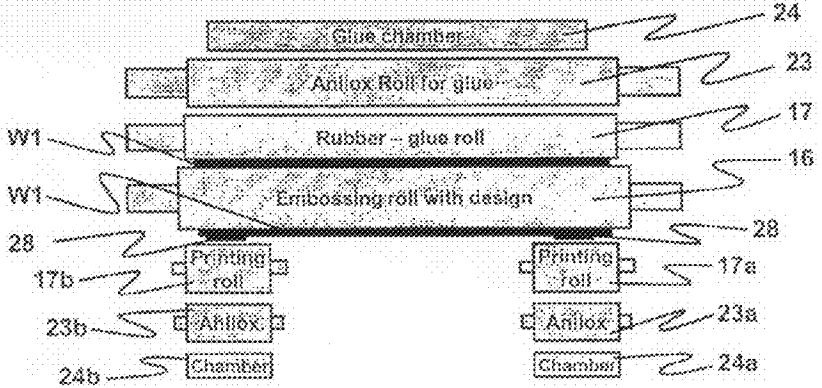

FIGS. 6*a* and 6*b* shows a converting machine being a combination of the machines illustrated in FIG. 4*a*, 5*a* and FIG. 4*b*, 5*b* respectively.

In the present invention for good perforation and embossing and register in toilet paper and kitchen towels using non- or light-coloured glue for ply-bonding a new marking system is presented being directly connected to the embossing station to get the best correlation. In the embodiments illustrated the mark is printed on the back-side of the top ply. In this case a small flexo printing unit can be used. Tissue is, however, transparent and therefore it can be seen and detected from the front side. As mentioned already, the mark can be located on one side of the printing roll, in the area of the cookie. No other design element should be in the circumference area of this mark. The sensor (e.g.) photodiode detects the mark from the front side. The printed mark is not visible on the finished product because it is cut away together with the cookie.

A special arrangement of the embossing design is recommended. Single design elements in the middle of a sheet are not suitable. Over the complete circumference there should be design elements. Otherwise, strong vibration would cause runability problems.

In the examples according to FIGS. 2 to 6, the technology described in FIG. 3 will preferably be used for coloured embossing with a good contrast. FIGS. 4 to 6 will preferably be used for non-coloured embossing or for coloured embossing with low contrast.

The invention claimed is:

1. A method of manufacturing a hygiene paper product, comprising:

providing a continuous paper web, the continuous paper web having sheets partly separated by perforation lines and wound to a log of predetermined longitudinal length;

moving the continuous paper web in a direction of the paper web's longitudinal extension;

providing at least one embossed pattern on the continuous paper web;

providing in an area of an embossing station at least one mark onto the continuous paper web, the at least one mark being in register to the embossed pattern, the at least one mark being applied to a back side of paper plies opposite to an embossing side;

sensing the mark and controlling perforating means for registering the perforation lines with the embossed pattern thereby imparting perforation lines to the continuous paper web in predetermined longitudinal distances;

winding up the resulting web to logs; and cutting the log into rolls.

2. The method according to claim 1, wherein the at least one mark or another mark is used for registering saw cuts in correlation to the embossed pattern.

3. The method according to claim 1, wherein the at least one mark is embossed onto the continuous paper web.

4. The method according to claim 1, whereby a marking substance is applied onto the paper web.

5. The method according to claim 4, wherein the at least one mark is an ink or coloured adhesive.

6. The method according to claim 3, wherein a substance is applied onto the embossed mark.

7. The method according to claim 6, wherein the substance is an ink or a coloured adhesive.

8. The method according to claim 1, wherein the at least one mark is a dot-mark or MD-line-mark for cutting control and/or a dot-mark or a CD-line-mark for register-control of perforation.

9. The method according to claim 1, wherein the at least one mark is applied to a front side of the continuous paper web being the embossing side.

10. The method according to claim 1, wherein the mark is detected on the front side of a continuous paper web.

11. The method according to claim 6, wherein the embossed pattern and the embossed mark(s) is/are applied by the same embossing means.

12. A method of manufacturing a hygiene paper product, comprising:

providing a continuous paper web, the continuous paper web having sheets partly separated by perforation lines and wound to a log of pre-determined longitudinal length;

moving the continuous paper web in a direction of the paper web's longitudinal extension;

providing at least one embossed pattern on the continuous paper web;

providing in an area of an embossing station at least one mark onto the continuous paper web, the at least one mark being in register to the embossed pattern, and the at least one mark is applied to a cookie-area of the log;

sensing the mark and controlling perforating means for registering the perforation lines with the embossed pattern thereby imparting perforation lines to the continuous paper web in predetermined longitudinal distances;

winding up the resulting web to logs; and cutting the log into rolls.

13. The method according to claim 12, wherein two different marks are applied to one and the same cookie-area at least one end of the log.

14. The method according to claim 12, wherein one of two different marks is applied to one cookie-area of the log and the other mark to the other cookie-area of the log.

15. The method according to claim 12, wherein the mark or another mark is used for registering saw cuts in correlation to the embossed pattern.

16. The method according to claim 12, wherein the at least one mark is embossed onto the continuous paper web.

17. The method according to claim 12, whereby a marking substance is applied onto the paper web.

18. The method according to claim 12, wherein the at least one mark is an ink or coloured adhesive.

19. The method according to claim 16, wherein a substance is applied onto the embossed mark.

20. The method according to claim 19, wherein the substance is an ink or a coloured adhesive.

21. The method according to claim 12, wherein the at least one mark is a dot-mark or MD-line-mark for cutting control and/or a dot-mark or a CD-line-mark for register-control of perforation.

22. The method according to claim 12, wherein the at least one mark is applied to a front side of the continuous paper web being an embossing side.

23. The method according to claim 12, wherein the mark is detected on the front side of the continuous paper web.

24. The method according to claim 19, wherein the embossed pattern and the embossed mark(s) is/are applied by the same embossing means.

* * * * *